US008816589B2

(12) United States Patent
Lee et al.

(10) Patent No.: US 8,816,589 B2
(45) Date of Patent: Aug. 26, 2014

(54) LIGHT EMITTING DIODE DRIVING APPARATUS

(71) Applicant: Samsung Electro-Mechanics Co., Ltd., Suwon (KR)

(72) Inventors: Youn Joong Lee, Seoul (KR); Deuk Hee Park, Suwon (KR); Sang Hyun Cha, Seoul (KR); Jae Shin Lee, Anyang (KR); Chang Seok Lee, Suwon (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 67 days.

(21) Appl. No.: 13/721,365

(22) Filed: Dec. 20, 2012

(65) Prior Publication Data

US 2013/0162144 A1 Jun. 27, 2013

(30) Foreign Application Priority Data

Dec. 23, 2011 (KR) ..... 10-2011-0141455

(51) Int. Cl.
*H05B 37/02* (2006.01)

(52) U.S. Cl.
USPC ..... 315/185 R; 315/224; 315/307

(58) Field of Classification Search
USPC ..... 315/185 R, 193, 186, 291, 307, 308, 224
See application file for complete search history.

(56) References Cited

U.S. PATENT DOCUMENTS

| | | | | |
|---|---|---|---|---|
| 8,193,725 | B2 * | 6/2012 | Chen et al. | 315/291 |
| 2011/0127923 | A1 * | 6/2011 | Lin et al. | 315/193 |
| 2011/0169423 | A1 * | 7/2011 | Huang et al. | 315/297 |

FOREIGN PATENT DOCUMENTS

KR 10-2011-0013167 2/2011

* cited by examiner

*Primary Examiner* — David H Vu

(57) ABSTRACT

Provided is an LED driving apparatus. The LED driving apparatus includes a plurality of LED groups each comprising one or more diodes, a switch group comprising a plurality of switch units connected respectively to the LED groups to drive the connected LED group when a control signal is activated, and a switch controlling unit configured to compare an input voltage of the LED groups with an output voltage of the LED groups, calculate a comparison value, and generate the control signal according to the comparison value. Accordingly, the LED driving apparatus drives the LED groups selectively according to the difference between the input voltage of the LED group and the output voltage of the LED group, thereby overcoming the problem of heat generation by forward voltage distribution.

19 Claims, 3 Drawing Sheets

LIGHT EMITTING DIODE DRIVING APPARATUS

CROSS-REFERENCE TO RELATED APPLICATIONS

This application claims the benefit of Korean Patent Application No. 10-2011-0141455 filed with the Korea Intellectual Property Office on Dec. 23, 2011, the disclosure of which is incorporated herein by reference.

BACKGROUND OF THE INVENTION

1. Field of the Invention

The present invention relates to a Light Emitting Diode (LED) driving apparatus, and more particularly, to an LED driving apparatus that can overcome the problem of heat generation by power loss.

2. Description of the Related Art

Light Emitting Diodes (LEDs) are replacing conventional illuminating light sources in more and more illuminating apparatuses because they have the advantages of small size, low power consumption, quick light-emitting operation, and long light-emitting lifetime.

In general, an LED driving apparatus drives an LED by converting an Alternating Current (AC) input into a Direct Current (DC) signal by a converter including a transformer and a smoothing capacitor.

Herein, the transformer has the advantage of electrical isolation between a primary side and a secondary side, but has the disadvantages of large size and high cost.

Also, the smoothing capacitor, which generally uses a large-capacity electrolytic condenser, has the disadvantages of large size and high cost. In addition, the smoothing capacitor has a shorter lifetime than the LED, thus reducing the entire system lifetime.

In order to overcome the above problems, there has been proposed an LED driving apparatus that uses a constant current source instead of a converter including a transformer and a smoothing capacitor.

However, in the LED driving apparatus using a constant current source, a voltage equal to an input voltage minus a voltage of driven diodes is applied to a drain of the constant current source, thus increasing an output resistance of the constant current source.

An increase in the output resistance increases the heat generation and power loss in the LED driving apparatus, thus degrading the reliability of the LED driving apparatus.

PRIOR ART DOCUMENT

Patent Document

Patent Document 1: Korean Patent Laid-open No. 2011-0013167 (Feb. 9, 2011)

SUMMARY OF THE INVENTION

The present invention has been invented in order to overcome the above-described problems and it is, therefore, an object of the present invention to provide a Light Emitting Diode (LED) driving apparatus that can overcome the problem of heat generation and power loss and can drive an LED even without using a transformer and a smoothing capacitor.

In accordance with one aspect of the present invention to achieve the object, there is provided a Light Emitting Diode (LED) driving apparatus, which includes: a plurality of LED groups each including one or more diodes; a switch group including a plurality of switch units connected respectively to the LED groups to drive the connected LED group when a control signal is activated; and a switch controlling unit configured to compare an input voltage of the LED groups with an output voltage of the LED groups, calculate a comparison value, and generate the control signal according to the comparison value.

The LED driving apparatus may further include a power supply unit including an Alternating Current (AC) power supply and a rectifier circuit.

The switch controlling unit may include: a voltage comparing unit configured to compare the input voltage with the output voltage and generate a comparison signal according to the comparison result; a duty determining unit configured to generate a pulse signal according to a difference between a ramp signal and the comparison signal of the voltage comparing unit and determine a duty of the pulse signal; and a control signal outputting unit configured to generate the control signal in response to an output signal of the duty determining unit.

The voltage comparing unit may include: an Analog-to-Digital Converter (ADC) configured to detect a level of an input signal and convert the input signal into a digital signal; a Digital-to-Analog Converter (DAC) configured to receive an output of the ADC and generate a reference voltage corresponding to the level of the input signal; an averaging unit configured to detect the output voltage of the LED groups and average the detected output voltage value; and a comparator unit configured to calculate a current error value through a difference between the reference voltage generated by the DAC and the output voltage generated by the averaging unit, and provide the duty determining unit with the comparison signal generated by amplifying the calculated current error value.

The duty determining unit may include: an oscillator unit configured to generate the ramp signal for Pulse Width Modulation (PWM) operation; a pulse signal generating unit configured to generate the pulse signal according to the difference between the ramp signal of the oscillator unit and the comparison signal of the voltage comparing unit; and a latch unit configured to latch the pulse signal of the pulse signal generating unit in response to a reference clock.

The reference clock may be generated by the oscillator unit.

The reference clock may be the ramp signal.

The control signal outputting unit may include: a buffer unit configured to buffer the level of the output signal of the duty determining unit; and a demultiplexer unit configured to generate the output signal of the duty determining unit as the control signal in response to an output of an ADC of the voltage comparing unit and output the generated control signal to the switch group.

The switch controlling unit may further include: a voltage generating unit configured to use the input voltage to generate an internal power supply voltage to be provided to the duty determining unit.

In accordance with another aspect of the present invention to achieve the object, there is provided a Light Emitting Diode (LED) driving apparatus, which includes: a plurality of LED groups connected in series; a switch group including a plurality of switch units connected between the LED groups and a ground voltage terminal to drive the connected LED group when a control signal is activated; and a switch controlling unit configured to compare an input voltage of the LED groups with an output voltage of the LED groups detected through a sensing resistor, calculate a comparison value, and generate the control signal according to the comparison value.

The sensing resistor may be disposed between the ground voltage terminal and one end of the switch group.

The LED driving apparatus may further include: a power supply unit including an Alternating Current (AC) power supply and a rectifier circuit.

The switch controlling unit may include: a voltage comparing unit configured to compare the input voltage with the output voltage and amplify the comparison value according to the comparison result to generate a comparison signal; a duty determining unit configured to generate a pulse signal according to a difference between a ramp signal and the comparison signal of the voltage comparing unit and remove a noise of the pulse signal; and a control signal outputting unit configured to generate the control signal in response to an output signal of the duty determining unit.

The voltage comparing unit may include: an Analog-to-Digital Converter (ADC) configured to detect a level of an input signal and convert the input signal into a digital signal; a Digital-to-Analog Converter (DAC) configured to receive an output of the ADC and generate a reference voltage corresponding to the level of the input signal; an averaging unit configured to detect the output voltage from the sensing resistor and average the detected output voltage value; and a comparator unit configured to calculate a current error value through a difference between the reference voltage generated by the DAC and the output voltage generated by the averaging unit, and provide the duty determining unit with the comparison signal generated by amplifying the calculated current error value.

The duty determining unit may include: an oscillator unit configured to generate the ramp signal for Pulse Width Modulation (PWM) operation; a pulse signal generating unit configured to generate the pulse signal according to the difference between the ramp signal of the oscillator unit and the comparison signal of the voltage comparing unit; and a latch unit configured to latch the pulse signal of the pulse signal generating unit in response to a reference clock.

The reference clock may be generated by the oscillator unit.

The reference clock may be the ramp signal.

The control signal outputting unit may include: a buffer unit configured to buffer the level of the output signal of the duty determining unit; and a demultiplexer unit configured to generate the output signal of the duty determining unit as the control signal in response to an output of an ADC of the voltage comparing unit and output the generated control signal to the switch group.

The switch controlling unit may further include a voltage generating unit configured to use the input voltage to generate an internal power supply voltage to be provided to the duty determining unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Hereinafter, specific embodiments of the present invention will be described with reference to the accompanying drawings. However, the present invention is provided for the illustrative purpose only but not limited thereto.

Descriptions of well-known configurations are omitted so as not to unnecessarily obscure the embodiments of the present invention. The following terms are defined in consideration of functions of the present invention and may be changed according to users or operator's intentions or customs. Thus, the terms shall be defined based on the contents described throughout the specification.

This invention may be embodied in different forms and should not be construed as limited to the embodiments set forth herein. Rather, these embodiments are provided so that this disclosure will be thorough and complete, and will fully convey the scope of the invention to those skilled in the art.

Hereinafter, Light Emitting Diodes (LEDs) in accordance with exemplary embodiments of the present invention will be described with reference to the accompanying drawings.

Figure 1:
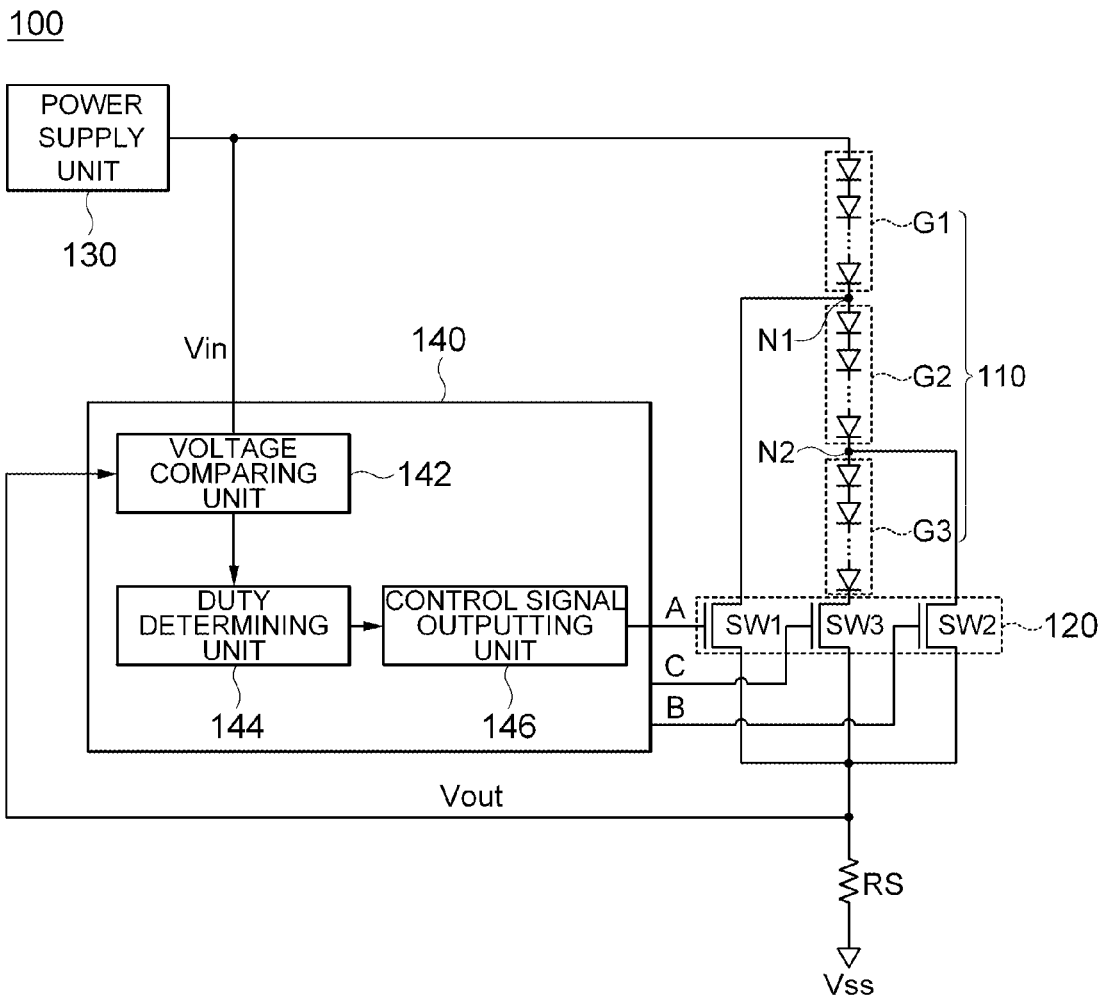
FIG. 1 is a block diagram illustrating an LED driving apparatus in accordance with an exemplary embodiment of the present invention.

FIG. 1 is a block diagram illustrating an LED driving apparatus in accordance with an exemplary embodiment of the present invention.

Referring to FIG. 1, an LED driving apparatus 100 in accordance with an exemplary embodiment of the present invention includes an LED group 110, a switch group 120, a power supply unit 130, and a switch controlling unit 140.

The LED group 110 may include first to third LED groups G1 to G3 connected in series.

Each of the first to third LED groups G1 to G3 includes one or more diodes connected in series, and each of the diodes has a cathode and an anode.

The switch group 120 may include first to third switch units SW1 to SW3 connected respectively to the first to third LED groups G1 to G3.

The first switch unit SW1 may be configured to drive the first LED group G1 in response to a first control signal A.

In an exemplary embodiment, the first switch unit SW1 may include an N-type Metal-Oxide Semiconductor (NMOS) transistor. The present invention is not limited thereto, and the first switch unit SW1 may include any switching element.

One end of the first switch unit SW1 is connected to a node N1 between the first and second LED groups G1 and G2, and the other end of the first switch unit SW1 is connected to a ground voltage terminal Vss. A gate of the first switch unit SW1 may receive the first control signal A as a gate signal from the switch controlling unit 140.

The second switch unit SW2 may be configured to drive the first and second LED groups G1 and G2 simultaneously in response to a second control signal B.

In an exemplary embodiment, the second switch unit SW2 may include an NMOS transistor. The present invention is not limited thereto, and the second switch unit SW2 may include any switching element.

One end of the second switch unit SW2 is connected to a node N2 between the second and third LED groups G2 and G3, and the other end of the second switch unit SW2 is connected to the ground voltage terminal Vss. A gate of the second switch unit SW2 may receive the second control signal B as a gate signal from the switch controlling unit 140.

The third switch unit SW3 may be configured to drive the first to third LED groups G1 to G3 simultaneously in response to a third control signal C.

In an exemplary embodiment, the third switch unit SW3 may include an NMOS transistor. The present invention is not limited thereto, and the third switch unit SW3 may include any switching element.

One end of the third switch unit SW3 is connected to the third LED group G3, and the other end of the third switch unit SW3 is connected to the ground voltage terminal Vss. A gate of the third switch unit SW3 may receive the third control signal C as a gate signal from the switch controlling unit 140.

In this manner, the switch units SW1 to SW3 of the switch group 120 may be configured to drive the connected LED groups G1 to G3 in response to the corresponding control signals A to C.

The power supply unit 130 may include an AC power supply (not illustrated) and a rectifier circuit (not illustrated).

The rectifier circuit may be connected to the AC power supply to rectify an AC power and provide the rectified power signal to the LED group 110 and the switch controlling unit 140. For example, the rectified power signal may be inputted at a frequency of 60 Hz to enable the LEDs to maintain an on state.

The switch controlling unit 140 may compare an input voltage Vin of the LED group 110 with an output voltage Vout of the LED group 110 and generate the control signals A to C for driving the LED group 110, on the basis of the comparison result.

That is, the switch controlling unit 140 may detect a difference between the input voltage Vin and the output voltage Vout and control a duty of a pulse signal according to the detected difference to enable a constant current to flow in each of the LED groups, thereby preventing the heat generation by power loss in the LED driving apparatus.

The switch controlling unit 140 may include a voltage comparing unit 142 configured to compare the input voltage Vin with the output voltage Vout and generate a comparison signal, a duty determining unit 144 configured to compare the comparison signal of the voltage comparing unit 142 with a ramp signal and determine a duty of the pulse signal, and a control signal outputting unit 146 configured to combine an output signal of the duty determining unit 144 with an output signal of an Analog-to-Digital Converter (ADC) and generate the first to third control signals A to C.

The switch controlling unit 140 will be described below in detail with reference to FIG. 2.

According to the present invention, the LED driving apparatus 100 may drive the LED groups selectively according to the difference between the input voltage Vin of the LED group 110 and the output voltage Vout of the LED group 110.

Also, the LED driving apparatus 100 may control a duty of the pulse signal to enable the same current to flow in each LED group of the LED group 110.

In this manner, instead of using a constant current source to drive all the diodes regardless of the input voltage level, the LED driving apparatus 100 may use the switch group 120 to control the duty and drive only the relevant LED group according to an input voltage level, thereby maintaining a constant current. Accordingly, the LED driving apparatus 100 may overcome the problem of unnecessary heat generation by power loss.

Figure 2:
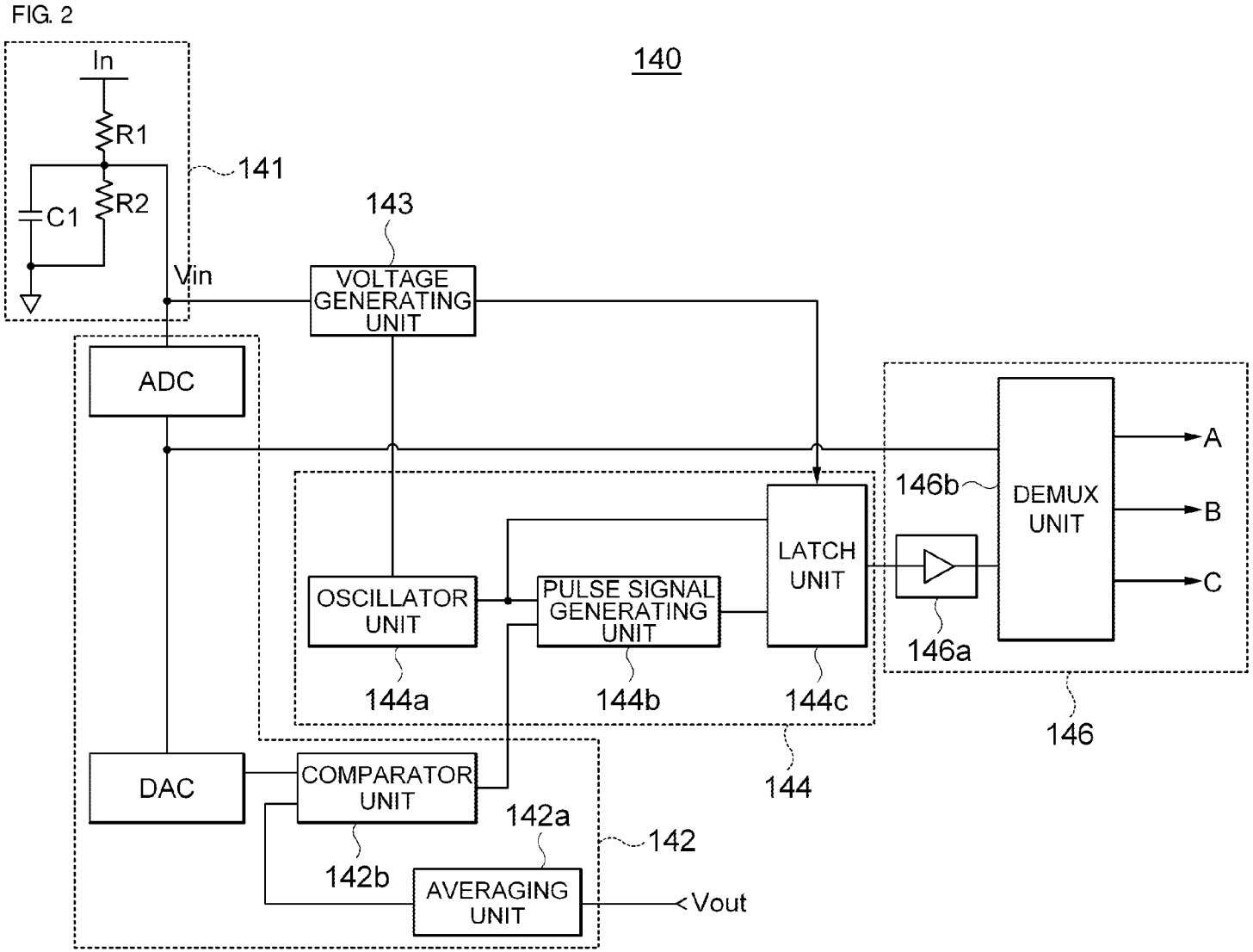
FIG. 2 is a block diagram illustrating a switch controlling unit of FIG. 1.

FIG. 2 is a block diagram illustrating a switch controlling unit of FIG. 1.

Referring to FIG. 2, the switch controlling unit 140 in accordance with an exemplary embodiment of the present invention includes a voltage comparing unit 142, a duty determining unit 144, and a control signal outputting unit 146.

The voltage comparing unit 142 compares the input voltage Vin with the output voltage Vout and generates a comparison signal. Also, the voltage comparing unit 142 may amplify the comparison result if necessary.

The voltage comparing unit 142 may include an Analog-to-Digital Converter (ADC), a Digital-to-Analog Converter (DAC), an averaging unit 142*a*, and a comparator unit 142*b*.

The ADC may convert an analog value of the input voltage Vin into a digital signal.

For example, it is assumed that the input voltage Vin to be inputted into the LED group 110 is 370 V. In this case, when the detected level of the input voltage Vin is lower than ⅓ time of 370 V, the ADC generates a first digital signal of '00'. When the detected level of the input voltage Vin is lower than ⅔ times of 370 V, the ADC generates a second digital signal of '01'. When the detected level of the input voltage Vin is 370 V, the ADC generates a third digital signal of '10'. The ADC may provide the first to third digital signals to the DAC and the control signal outputting unit 146.

Herein, the first digital signal may be used to drive the first switch unit SW1. Also, the second digital signal may be used to drive the second switch unit SW2, and the third digital signal may be used to drive the third switch unit SW3.

The level of the input voltage Vin inputted into the ADC is not a voltage level inputted from the power supply unit 130 to the LED group 110, but a voltage level divided by a voltage dividing unit 141 disposed at a front end of the voltage comparing unit 142.

When the voltage dividing unit 141 divides a current of the input voltage Vin and inputs the result into the ADC, it is efficient in adjusting the internal voltages (dynamic ranges) of the comparator unit 142*b* and a pulse signal generating unit 144*b* that will be described below.

The DAC may receive the output of the ADC and provide the comparator unit 142*b* with a reference voltage corresponding to an AC input level. In an exemplary embodiment, the reference voltage may vary according to the level of the input voltage Vin.

However, the DAC is not limited thereto, and may not be used according to other exemplary embodiments. When the DAC is not used, an input voltage of the ADC may be used as the reference voltage.

The averaging unit 142*a* may detect the output voltage Vout of the LED group 110 through a sensing resistor RS disposed between the LED group 110 and the ground voltage terminal Vss, average the detected output voltage (Vout) value, and provide the resulting value to the comparing unit 142*b*.

The comparator unit 142*b* may compare the reference voltage received from the DAC with the output voltage Vout received from the averaging unit 142*a*, and provide a comparison signal to the duty determining unit 144.

Specifically, when the reference voltage is higher than the output voltage Vout, the comparator unit 142*b* may generate a high-level comparison signal and output the high-level comparison signal to the duty determining unit 144.

On the other hand, when the reference voltage is lower than the output voltage Vout, the comparator unit 142*b* may generate a low-level comparison signal and output the low-level comparison signal to the duty determining unit 144.

The duty determining unit 144 may calculate a difference between the ramp signal and the comparison signal outputted from the voltage comparing unit 142, determine a duty of the pulse signal, and remove a noise.

The duty determining unit 144 may include an oscillator unit 144*a*, a pulse signal generating unit 144*b*, and a latch unit 144*c*.

For Pulse Width Modulation (PWM) operation, the oscillator unit 144*a* may generate a ramp signal and provide the ramp signal to the pulse signal generating unit 144*b*.

The pulse signal generating unit 144*b* may receive the ramp signal from the oscillator unit 144*a* and the comparison signal from the voltage comparing unit 142, generate a pulse signal on the basis of the ramp signal and the comparison signal, and output the pulse signal to the latch unit 144*c*. For example, the pulse signal generating unit 144*b* may include an amplifier.

The ramp signal may be a periodic clock signal, and the comparison signal may be a DC signal having a level determined by feedback.

Accordingly, when the ramp signal is higher than the comparison signal, the pulse signal generating unit 144*b* may generate a low-level pulse signal.

On the other hand, when the ramp signal is lower than the comparison signal, the pulse signal generating unit 144*b* may generate a high-level pulse signal.

The latch unit 144*c* may latch the pulse signal of the pulse signal generating unit 144*b* in response to a reference clock, thereby determining a duty of the pulse signal and remove a noise of the pulse signal. Herein, the reference clock may be the ramp signal generated by the oscillator unit 144*a*.

For example, the latch unit 144*c* may include a Reset/Set (RS) flip-flop.

An output of the latch unit 144*c* may be formed in the shape of pulses. The output of the latch unit 144*c* may be applied through the control signal outputting unit 146 to the gates of the switch group 120 to control the switching on/off of the switch group 120.

The control signal outputting unit 146 may combine the output signal of the duty determining unit 144 with the output signal of the ADC, generate the first to third control signals A to C, and output the first to third control signals A to C to the switch group 120.

The control signal outputting unit 146 may include a buffer unit 146*a* and a demultiplexer (DEMUX) unit 146*b*.

The buffer unit 146*a* may buffer the level of the output signal of the duty determining unit 144 and provide the result to the DEMUX unit 146*b*. Although not illustrated in the drawings, the buffer unit 146*a* may include, for example, an even number of inverters.

The DEMUX unit 146*b* may combine the output signal of the ADC with the output signal of the duty determining unit 144, generate the first to third control signals A to C, and output the first to third control signals A to C to the switch group 120.

Specifically, when receiving the first digital signal from the ADC, the DEMUX unit 146*b* may activate only the first control signal A to operate the first switch unit SW1. Herein, the duty cycle of the first control signal A may be determined by the output signal of the duty determining unit 144.

When receiving the second digital signal from the ADC, the DEMUX unit 146*b* may activate only the second control signal B to operate the second switch unit SW2. Herein, the duty cycle of the second control signal B may be determined by the output signal of the duty determining unit 144.

When receiving the third digital signal from the ADC, the DEMUX unit 146*b* may activate only the third control signal C to operate the third switch unit SW3. Herein, the duty cycle of the third control signal C may be determined by the output signal of the duty determining unit 144.

In another exemplary embodiment, the LED driving apparatus 100 may further include a voltage generating unit 143 configured to use an AC current to generate an internal power supply voltage that is to be provided to the oscillator unit 144*a* and the latch unit 144*c*. For example, the internal power supply voltage may be a high voltage VCC of about 20 V.

As described above, the LED driving apparatus 100 may drive the LED groups selectively according to the difference between the input voltage Vin of the LED group 110 and the output voltage Vout of the LED group 110.

Also, the LED driving apparatus 100 may control a duty of the pulse signal to enable the same current to flow in each LED group of the LED group 110.

In this manner, instead of using a constant current source to drive all the diodes regardless of the input voltage level, the LED driving apparatus 100 may use the switch group 120 to control the duty and drive only the relevant LED group according to an input voltage level, thereby maintaining a constant current. Accordingly, the LED driving apparatus 100 may overcome the problem of heat generation by forward voltage distribution.

Figure 3:
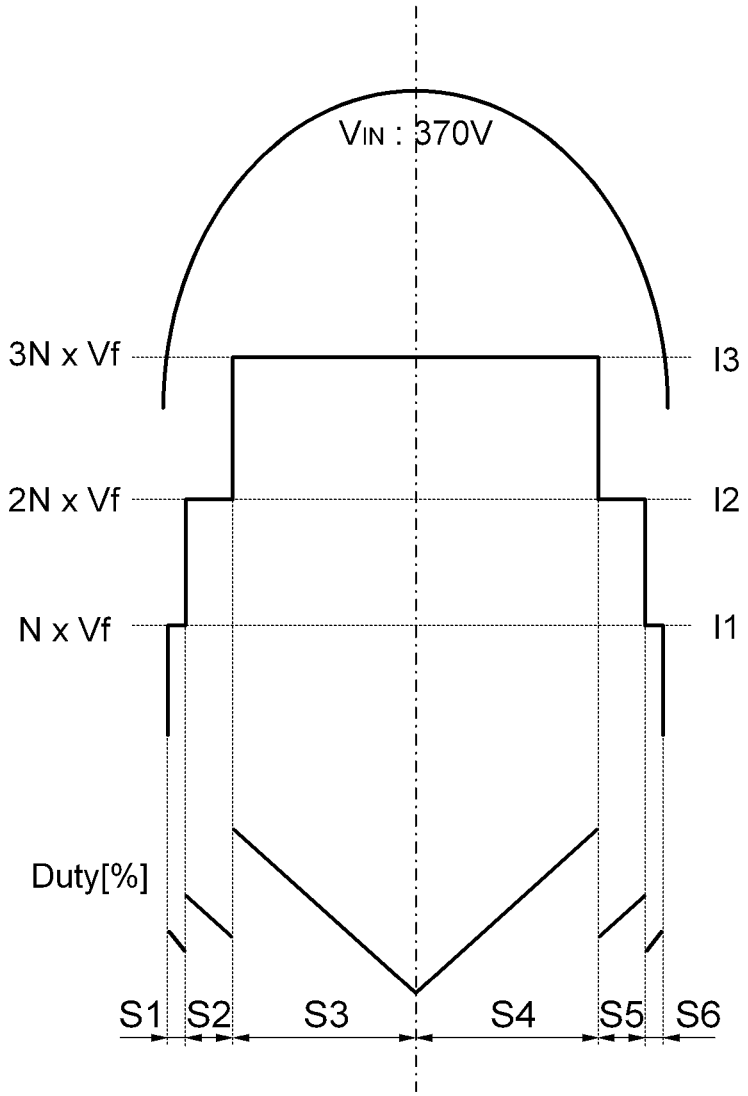
FIG. 3 is a diagram illustrating an output waveform of an LED driving apparatus in accordance with an exemplary embodiment of the present invention.

FIG. 3 is a diagram illustrating an output waveform of the LED driving apparatus 100 in accordance with an exemplary embodiment of the present invention.

Referring to FIG. 3, the LED driving apparatus 100 may sequentially activate the duty-controlled first to third control signals A to C according to the input voltage Vin of the LED group 110 and the output signal Vout of the LED group 110.

The first to third LED groups G1 to G3 may be sequentially driven in response to the first to third control signals A to C, and the output signal of the LED group 110 may be formed in the shape of steps as illustrated in FIG. 3. Each of the first to third LED groups G1 to G3 may include an N number of diodes, and the LEDs may have the same forward voltage VF.

In first and sixth periods S1 and S6 of the graph of FIG. 3, the first switch unit SW1 is activated to drive only the first LED group G1. N*VF voltages may be generated in the first and sixth periods S1 and S6.

In second and fifth periods S2 and S5, the second switch unit SW2 is activated to drive the first and second LED groups G1 and G2. 2N*VF voltages may be generated in the second and fifth periods S2 and S5.

In third and fourth periods S3 and S4, the third switch unit SW3 is activated to drive the first to third LED groups G1 to G3. 3N*VF voltages may be generated in the third and fourth periods S3 and S4.

In this manner, instead of using a constant current source to drive all the diodes regardless of the input voltage level, the LED driving apparatus 100 may use the switch group 120 to drive only the relevant LED group according to an input voltage level. Accordingly, the LED driving apparatus 100 may overcome the problem of unnecessary heat generation by power loss.

When the input voltage Vin of the LED group 110 increases, the LED driving apparatus 100 may use the switch controlling unit 140 of FIG. 2 to decrease the duty in the first to third periods S1 to S3.

On the other hand, when the input voltage Vin of the LED group 110 decreases, the LED driving apparatus 100 may use the switch controlling unit 140 of FIG. 2 to increase the duty in the fourth to sixth periods S4 to S6.

As described above, the LED driving apparatus 100 may control the duties of the increasing periods S1 to S3 and the decreasing periods S4 to S6 of the input voltage Vin. This may maintain constant currents I1, I2 and I3 in the LED driving apparatus 100, thereby overcome the problem of heat generation by power loss more accurately.

As described above, the LED driving apparatuses according to the exemplary embodiments of the present invention can drive an LED even without using a transformer and a smoothing capacitor.

Also, the LED driving apparatuses according to the exemplary embodiments of the present invention can overcome the problem of unnecessary heat generation and power loss by controlling the number of LED groups turned on according to a change in the LED input voltage.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A Light Emitting Diode (LED) driving apparatus, which comprises:

a plurality of LED groups each comprising one or more diodes;

a switch group comprising a plurality of switch units connected respectively to the LED groups to drive the connected LED group when a control signal is activated; and a switch controlling unit configured to compare an input voltage of the LED groups with an output voltage of the LED groups, calculate a comparison value, and generate the control signal according to the comparison value.

2. The LED driving apparatus according to claim 1, which further comprises:

a power supply unit comprising an Alternating Current (AC) power supply and a rectifier circuit.

3. The LED driving apparatus according to claim 1, wherein the switch controlling unit comprises:

a voltage comparing unit configured to compare the input voltage with the output voltage and generate a comparison signal according to the comparison result;

a duty determining unit configured to generate a pulse signal according to a difference between a ramp signal and the comparison signal of the voltage comparing unit and determine a duty of the pulse signal; and a control signal outputting unit configured to generate the control signal in response to an output signal of the duty determining unit.

4. The LED driving apparatus according to claim 3, wherein the voltage comparing unit comprises:

an Analog-to-Digital Converter (ADC) configured to detect a level of an input signal and convert the input signal into a digital signal;

a Digital-to-Analog Converter (DAC) configured to receive an output of the ADC and generate a reference voltage corresponding to the level of the input signal;

an averaging unit configured to detect the output voltage of the LED groups and average the detected output voltage value; and a comparator unit configured to calculate a current error value through a difference between the reference voltage generated by the DAC and the output voltage generated by the averaging unit, and provide the duty determining unit with the comparison signal generated by amplifying the calculated current error value.

5. The LED driving apparatus according to claim 3, wherein the duty determining unit comprises:

an oscillator unit configured to generate the ramp signal for Pulse Width Modulation (PWM) operation;

a pulse signal generating unit configured to generate the pulse signal according to the difference between the ramp signal of the oscillator unit and the comparison signal of the voltage comparing unit; and a latch unit configured to latch the pulse signal of the pulse signal generating unit in response to a reference clock.

6. The LED driving apparatus according to claim 5, wherein the reference clock is generated by the oscillator unit.

7. The LED driving apparatus according to claim 5, wherein the reference clock is the ramp signal.

8. The LED driving apparatus according to claim 3, wherein the control signal outputting unit comprises:

a buffer unit configured to buffer the level of the output signal of the duty determining unit; and a demultiplexer unit configured to generate the output signal of the duty determining unit as the control signal in response to an output of an ADC of the voltage comparing unit and output the generated control signal to the switch group.

9. The LED driving apparatus according to claim 3, wherein the switch controlling unit further comprises:

a voltage generating unit configured to use the input voltage to generate an internal power supply voltage to be provided to the duty determining unit.

10. A Light Emitting Diode (LED) driving apparatus, which comprises:

a plurality of LED groups connected in series;

a switch group comprising a plurality of switch units connected between the LED groups and a ground voltage terminal to drive the connected LED group when a control signal is activated; and a switch controlling unit configured to compare an input voltage of the LED groups with an output voltage of the LED groups detected through a sensing resistor, calculate a comparison value, and generate the control signal according to the comparison value.

11. The LED driving apparatus according to claim 10, wherein the sensing resistor is disposed between the ground voltage terminal and one end of the switch group.

12. The LED driving apparatus according to claim 10, which further comprises:

a power supply unit comprising an Alternating Current (AC) power supply and a rectifier circuit.

13. The LED driving apparatus according to claim 11, wherein the switch controlling unit comprises:

a voltage comparing unit configured to compare the input voltage with the output voltage and amplify the comparison value according to the comparison result to generate a comparison signal;

a duty determining unit configured to generate a pulse signal according to a difference between a ramp signal and the comparison signal of the voltage comparing unit and remove a noise of the pulse signal; and a control signal outputting unit configured to generate the control signal in response to an output signal of the duty determining unit.

14. The LED driving apparatus according to claim 13, wherein the voltage comparing unit comprises:

an Analog-to-Digital Converter (ADC) configured to detect a level of an input signal and convert the input signal into a digital signal;

a Digital-to-Analog Converter (DAC) configured to receive an output of the ADC and generate a reference voltage corresponding to the level of the input signal;

an averaging unit configured to detect the output voltage from the sensing resistor and average the detected output voltage value; and a comparator unit configured to calculate a current error value through a difference between the reference voltage generated by the DAC and the output voltage generated by the averaging unit, and provide the duty determining unit with the comparison signal generated by amplifying the calculated current error value.

15. The LED driving apparatus according to claim 13, wherein the duty determining unit comprises:

an oscillator unit configured to generate the ramp signal for Pulse Width Modulation (PWM) operation;

a pulse signal generating unit configured to generate the pulse signal according to the difference between the ramp signal of the oscillator unit and the comparison signal of the voltage comparing unit; and a latch unit configured to latch the pulse signal of the pulse signal generating unit in response to a reference clock.

16. The LED driving apparatus according to claim 15, wherein the reference clock is generated by the oscillator unit.

17. The LED driving apparatus according to claim 15, wherein the reference clock is the ramp signal.

18. The LED driving apparatus according to claim 13, wherein the control signal outputting unit comprises:

a buffer unit configured to buffer the level of the output signal of the duty determining unit; and a demultiplexer unit configured to generate the output signal of the duty determining unit as the control signal in response to an output of an ADC of the voltage comparing unit and output the generated control signal to the switch group.

19. The LED driving apparatus according to claim 13, wherein the switch controlling unit further comprises:

a voltage generating unit configured to use the input voltage to generate an internal power supply voltage to be provided to the duty determining unit.

* * * * *